United States Patent [19]

Shiu

[11] 4,003,184

[45] Jan. 18, 1977

[54] METHOD AND APPARATUS FOR PACKAGING SLICED BACON AND THE LIKE

[76] Inventor: Thomas B. Shiu, 131 Stirrup Lane, Burr Ridge, Ill. 60521

[22] Filed: Apr. 28, 1975

[21] Appl. No.: 572,431

[52] U.S. Cl. ..... 53/32; 53/40; 53/376; 53/DIG. 1; 264/296; 264/322; 426/121

[51] Int. Cl.[2] ..... B65B 11/08

[58] Field of Search ..... 53/32, 170, 206, 207, 53/376, DIG. 1, 40; 426/121, 420; 93/49 R, 33 H, 58.2; 264/294, 295, 296, 322, 339

[56] References Cited

UNITED STATES PATENTS

| | | | |
|---|---|---|---|
| 1,431,476 | 10/1922 | MacInnes | 264/339 X |
| 1,940,106 | 12/1933 | Snyder | 93/58.2 R |
| 1,986,857 | 1/1935 | Roberts | 93/49 R |
| 2,077,508 | 4/1937 | Bierer | 264/339 X |
| 2,379,127 | 6/1945 | Werner | 93/49 R |
| 2,892,217 | 6/1959 | Luboshez | 264/339 X |
| 2,974,460 | 3/1961 | Walther | 53/376 |
| 3,002,432 | 10/1961 | Wendshuh | 93/49 R |
| 3,148,103 | 9/1964 | Gallagher | 264/294 X |
| 3,320,225 | 5/1967 | Bradbury | 264/295 X |
| 3,389,532 | 6/1968 | Stelzer | 53/206 X |
| 3,398,660 | 8/1968 | Watrous | 93/49 R |
| 3,413,706 | 12/1968 | Shade et al. | 264/295 X |
| 3,615,149 | 10/1971 | Malone et al. | 264/295 X |
| 3,803,332 | 4/1974 | Seiferth | 426/121 |
| 3,900,550 | 8/1975 | Oliver et al. | 264/295 X |

*Primary Examiner*—Travis S. McGehee
*Assistant Examiner*—John Sipos
*Attorney, Agent, or Firm*—Mason, Kolehmainen, Rathburn & Wyss

[57] ABSTRACT

Method and apparatus for packaging sliced bacon and the like comprises placing a shingle of bacon strips on a tray formed of a unitary sheet of thin, semi-rigid, impervious plastic material having an integral flap along one side, heating said material along a fold line between the flap and tray, folding the integral flap over an edge portion of the shingle of sliced bacon on the tray, and applying a permanent set to the folded flap to permanently overlie said edge portion of said shingle of bacon.

12 Claims, 7 Drawing Figures

METHOD AND APPARATUS FOR PACKAGING SLICED BACON AND THE LIKE

The present invention relates to a new and improved method and apparatus for packaging sliced bacon and the like for display and sale in retail stores. More particularly, the package of the present invention is especially adapted for use with sliced bacon arranged in a shingled array with portions of the slices overlapping adjacent slices.

Presently sliced bacon is packaged by providing a semirigid paper or fibrous board support or tray on which a plurality of bacon slices are arranged in edge overlapping or shingled relation, commonly known as a shingle of bacon. The paper board tray is provided with a perforated scoring line along one edge defining a flap which is then folded over to cover an edge portion of a bacon shingle placed on the tray and the lean edge portions of the slices are displayed for viewing through a thin, transparent upper sheet of a pouch or enclosure for the tray and bacon. Display of only the lean edges of the bacon strips in the package makes the product more attractive and merchantable. However, trays having foldable edge flaps formed of fibrous paper material and provided with cuts or perforations along the flap are often unsightly because the exposed edges of the fibrous material at the cuts or perforations as well as the exposed edges of any windows or openings cut in the fibrous material, permit the material to absorb grease, blood or other liquids from the bacon. This action known as wicking is similar to the action of a blotter and causes discoloration and edge stains on the package which generally detracts from the appearance and saleability of the bacon contained therein.

Presently, available bacon packages having trays formed of fibrous board like material have the tendency to absorb moisture from the bacon and this reduces the net weight of the bacon to the purchaser and causes the tray to become limp rather than stiff and thus, less easier to handle.

The new and improved method and apparatus for packaging bacon in accordance with the present invention permits the use of impervious, semi-rigid plastic material in the package and eliminates the so-called "wicking" problem. This results in a cleaner, neater appearing bacon package.

It is an object of the present invention to provide a new and improved method and apparatus for packaging sliced bacon and the like.

Another object of the present invention is to provide a new and improved method and apparatus for packaging sliced bacon wherein the package is formed of low cost, semi-rigid, impervious plastic sheet material.

Yet another object of the present invention is to provide a new and improved method and apparatus of the character described wherein the material used for the package is impervious and does not tend to absorb liquids such as blood, grease, water from the food contained thereby.

Another object of the present invention is to provide a new and improved method of packaging sliced bacon and the like for attractive display and sale.

Another object of the present invention is to provide a new and improved apparatus for making improved packages for sliced bacon and the like of the character described having an integral flap folded over along the edge of the bacon on the tray of the package.

These and other objects and advantages of the present invention are accomplished by providing a new and improved method and apparatus for packaging sliced bacon wherein a shingle of bacon is placed on a tray formed of a thin sheet of semi-rigid, impervious transparent plastic material having an integral flap formed along one side edge. After a shingle of bacon is placed on the tray, the material is heated along a fold line between the flap and the tray and the flap is folded to overly a portion of the sliced bacon along an edge portion of the shingle array of slices. After heating and folding, a permanent set is applied to the flap so that the flap remains in folded overlying relation along the edge portion of the bacon shingle.

Heat and mechanical pressure are applied to fold over the flaps and no perforations, cuts or slits are required along the fold line between the tray and the flap. After the folded flap is set, the package is passed into an apparatus for enclosing in a clear plastic pouch or wrapper envelope and upper and/or lower cover sheets are heat sealed around the peripheral edges of the tray to fully enclose and seal the shingle of bacon slices in the package.

For a better understanding of the present invention reference should be had to the following detailed description and claims taken in conjunction with the drawings in which:

Figure 1:
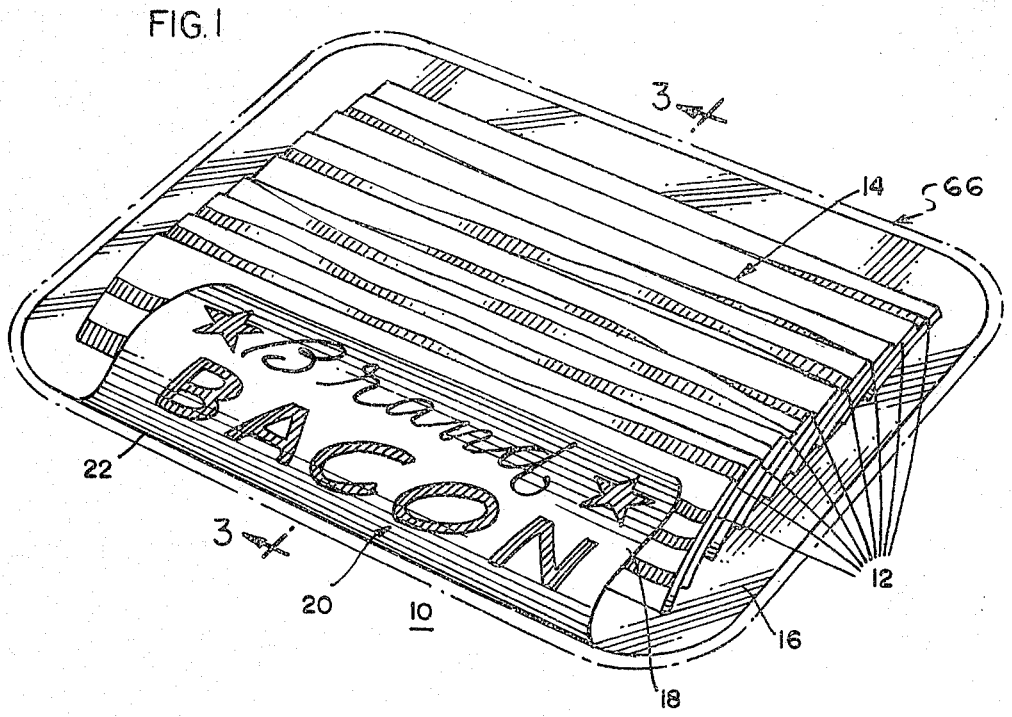
FIG. 1 is a top perspective view of a package for shingles of sliced bacon and the like with an outline of an enclosing pouch or envelope shown in phantom.
Figure 2:
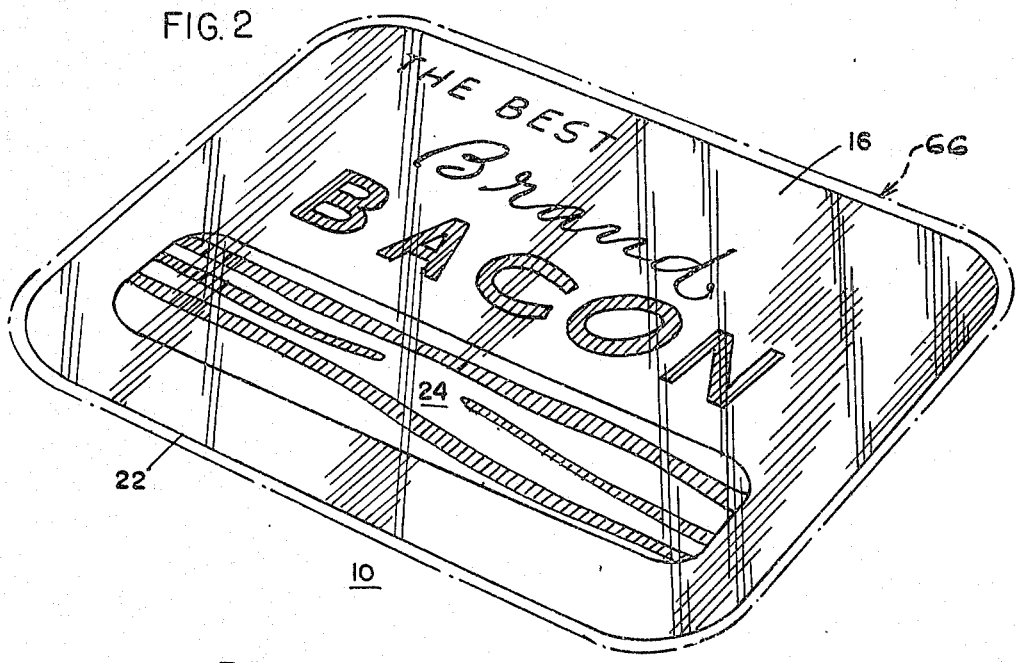
FIG. 2 is a bottom perspective view of the bacon package of FIG. 1.
Figure 3:
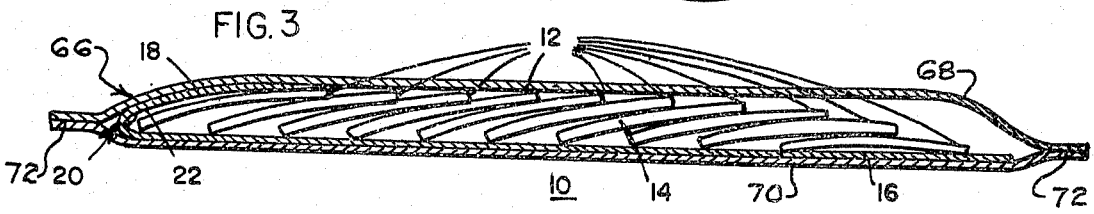
FIG. 3 is a transverse cross sectional view taken substantially along lines 3—3 of FIG. 1.

Referring now more particularly to the drawings, therein is illustrated a package for shingles of sliced bacon and the like referred to generally by the reference numeral 10. As best shown in FIGS. 1 and 3 the package 10 is designed to contain a plurality of elongated bacon slices 12 arranged in edge overlapping or shingled relationship commonly known and referred to hereinafter as a shingle of bacon or bacon shingle 14. Normally, in a shingle, the bacon slices 12 are arranged with their lean edges exposed to provide a better appearance and increased saleability of the product in its package.

Figures 4, 5, 6, 7:
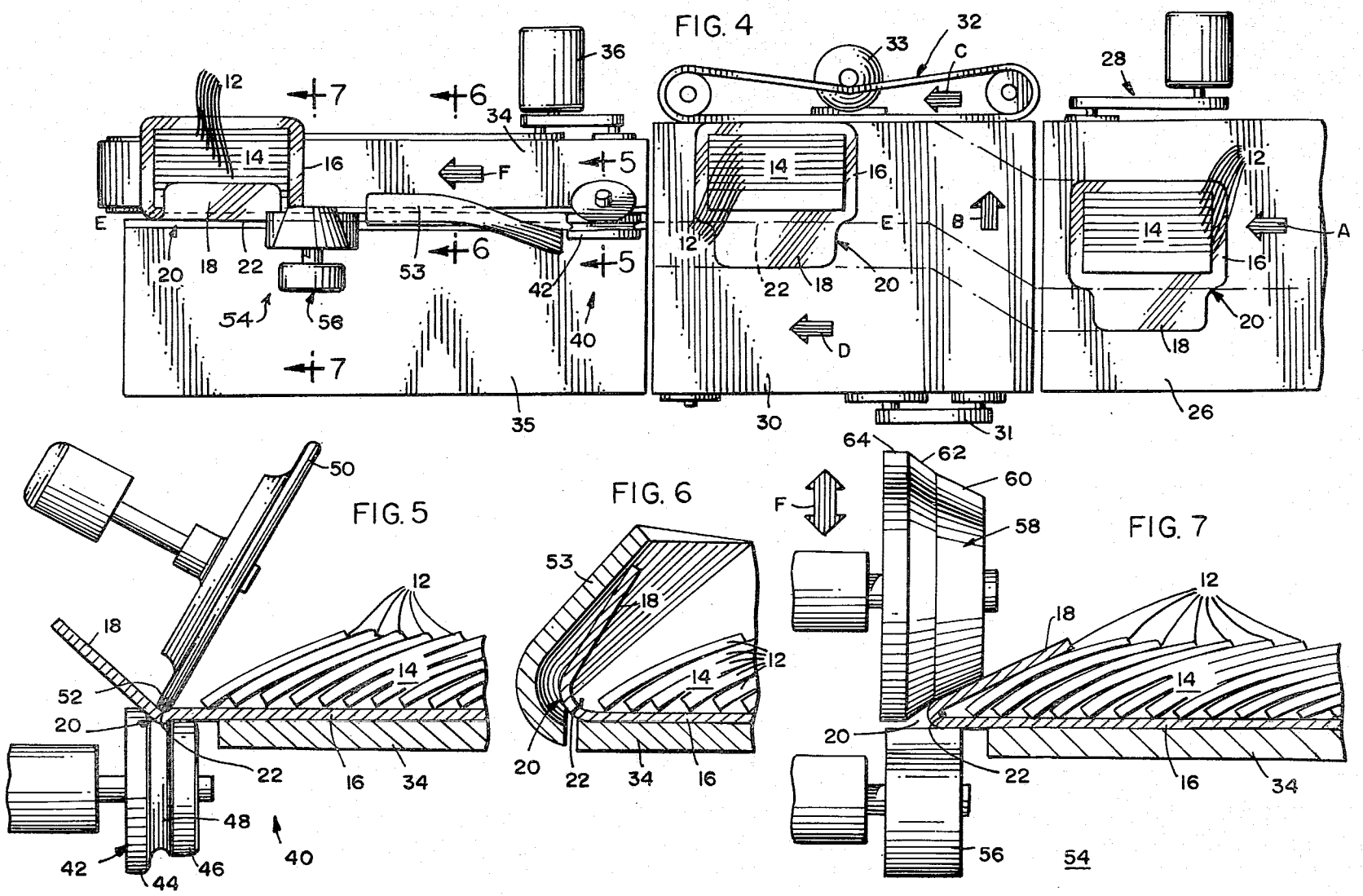
FIG. 4 is a top plan view of apparatus in accordance with the features of the present invention for producing the packages of FIG. 1.
FIG. 5 is a fragmentary cross sectional view taken substantially along lines 5—5 of FIG. 4.
FIG. 6 is a fragmentary cross sectional view taken substantially along lines 6—6 of FIG. 4.
FIG 7 is a cross sectional view taken substantially along lines 7—7 of FIG. 4.

The package 10 includes a generally rectangular, bottom or supporting tray 16 with an integral flap 18 along one edge, also of rectangular shape. As best shown in FIG. 4, each tray 16 and its flap 18 comprises a unitary sheet or blank originally in flat condition and cut to shape as shown, generally referred to by the reference numeral 20. The sheets 20 are used to support the bacon shingles 14 during the packaging process and as the process continues the integral flaps 18 are folded along a fold line 22 extending between the tray portion of the sheets and the flap. When folded over, the flap overlies an edge portion of a bacon shingle 14 placed on the tray 16 as best illustrated in FIGS. 1 and 7.

The flat sheets 20 are cut from semi-rigid, impervious plastic material such as polystyrene film, which material is low in cost and has a number of desirable characteristics for use in a food packaging. The U.S. Department of Agriculture has indicated that polystyrene material such as that sold under the tradename POLY-FLEX manufactured by Monsanto Company meets the requirements of the Food and Drug Administration for use in food packages and also meets the requirements of Food Additive Regulation 121.2510. The semi-rigid, transparent, polystyrene sheets 20 may range in thickness from 4 to 10 thousandths of an inch dependent on the desired stiffness required. Because of the impervious, nonabsorbent nature of the material and because there is no requirement for cutting perforations or windows in the sheet material there are no cut edges in the tray or flap. Moreover, because the material is plastic and impervious there is no tendency to absorb blood, grease, water or other liquids from the meat. In prior packages using fibrous paper board trays, liquid absorbtion often causes an unsightly appearance known as "wicking" or "staining". The polystyrene sheets 20 may be transparent to permit viewing of the food product and the upper surface of the tray 16 and the underside of the flap 18 when folded (as viewed in FIG. 1) may be free of any printing ink, coloring agents and the like which might be incompatible with or cause contamination of the bacon shingles 14.

Normally, the polystyrene sheets are printed or colored on one side only and this side is out of direct contact with the bacon in the package. Because the printing and/or coloring matter does not come in direct contact with the bacon, a much wider variety of inks and coloring materials may be used than heretofore possible.

Referring to FIGS. 4, 5, 6 and 7, after slicing, stacking and weighing, the bacon shingles are placed on the sheets 20 which serve as supports for the product as it moves along a conveyor 26. The conveyor is powered by a drive unit 28 to move the loaded sheets 20, each containing a shingle of bacon 14 thereon, in the direction of the arrow A. The conveyor 26 may be a component of an existing production line in a packing plant.

The loaded packages are then directed to a separate alignment conveyor indicated generally by the reference numeral 30 which is sloped downwardly in the direction of the arrow B so that the packages move against an upstanding side guide belt conveyor generally indicated by the reference numeral 32 and driven by a motor unit 33. The side guide belt conveyor includes a drive run moving in the direction indicated by the arrow C in the same direction of travel of the upper run of the horizontal support belt conveyor 30 driven by the drive unit 31. As the packages approach the discharge end of the conveyor 30, the fold axis 22 between the tray portion 16 and edge flap 18 of each sheet 20 is accurately aligned with and moving along a fold path indicated by the dashed line E—E (FIG. 4). The packages are transferred onto the upper run of a horizontal driving belt 34 moving in the direction of the arrow F and driven by drive unit 26. The upper run of the belt 34 provides moving support for the packages as the integral flaps 18 are folded over against an edge portion of the bacon shingles 14 along the fold axes 22 between the tray portions and flap. The fold axis 22 of each package is aligned to travel along the path of line E—E during the folding process.

The loaded sheets 20 pass a first flap folding station indicated generally by the reference numeral 40 wherein the polystyrene is heated along the fold axis 22 between the tray 16 and the flap 18. Styrene plastic is relatively stiff or rigid and is deformed much easier after it is elevated in temperature. The initial heating and deflection of the flap 18 is accomplished with a heated lower roll 42 having a large diameter, outer section 44 and a smaller diameter, inside section 46, which sections are separated by a grooved middle section 48. The fold axes 22 of the moving sheets 20 are aligned to pass directly above the groove or trough forming middle section 48 of the lower roll 42 and the material is heated and depressed into the grooved lower roll by a heated, upper roll 50. An elongated groove or trough 52 (FIG. 5) is formed in the sheet causing the flap 18 to be folded over and partially deflected as shown. The heated rolls 42 and 50 elevate the temperature of the polystyrene material sufficiently to provide a permanent bend of the flap 18 to eliminate the possibility of cracking or splitting of the material which will normally occur if the material is deflected or folded over at lower temperatures such as room temperature or lower. The upper roll 50 is arranged at an acute angle relative to the lower roll 42 to facilitate folding over of the flap and formation of the trough 52 in the sheet along the fold axis. The clearance or spacing between the edges of the rolls is adjustable to provide for the desired amount of depression in the material to form the trough 52.

After the trough is formed along the fold axis 22, the flap 18 is moved into engagement against a fixed fold guide 53 (FIG. 6) wherein the outer edge of the flap 18 is cammed downwardly toward the edge of the shingle of bacon 14 at progressively sharper angles as the package moves along on the conveyor. This progressive deflection of the flap further insures against splitting or cracking of the material along the fold line as the folding action is smooth rather than abrupt.

After passage by the fold guide 53, the flaps 18 are further deflected to a final set position in a final folding stage generally indicated by the reference number 54. The finished or final bending between the flap 18 and its tray portion 16 is accomplished by a pair of heated, driven rolls 56 and 58 which engage the packages as best shown in FIG. 7. The lower heated roll 56 engages the underside of the trays 16 along the fold line 22 and supports the edges of the package as the upper surface of the folded flaps 18 are biased downwardly against the edge portion of a shingle of bacon 14 on the tray by the heated upper roll 58. The upper roll 58 is generally frustroconical in shape and includes inside, intermediate and outer segments 60, 62 and 64, each segment respectively having progressively greater hardness characteristics. The inner segment 60 is the softest one having a "Durometer" hardness less than the other segments and accordingly the flap 18 is not creased or cracked when biased against the bacon shingle by the upper roll. The upper roll 58 is vertically adjustable as indicated by the arrow F (FIG. 7) to provide a selected degree of compression or deflection of the folded over flaps 18 against the shingles of bacon 14 placed on the trays. After the packages pass through the final fold stage 54, the material cools or sets and the flap 18 then has a permanent set angle with respect to the tray as indicated in FIGS. 3 and 7.

The packages are next inserted into pouches or envelopes 66 formed of thin transparent plastic film including upper and lower covers 68 and 70. The pouch is then heat sealed around the peripheral edge as at 72. The pouch or envelope 66 seals the package to retain freshness of the product during display and sale. After a consumer has purchased a package of bacon as described, one edge of the pouch may be opened and the tray 16 and bacon is easily slipped into and out of the pouch on the open side as the bacon is used from time to time. The polystyrene tray 16 being of semi-rigid material provides suitable stiffness for easy insertion of the bacon into the opened pouch and the folded over flap 18 tends to hold the bacon on the tray 16 until the last few slices remain.

Heretofore, semi-rigid impervious plastics were not used in bacon packages because slitting or cuts were required for windows and along the fold line of the flap and the plastic material would continue to tear or crack from these cuts or slits after initial die cutting and folding. Fibrous board material was used because it does not tend to further tear or crack like the new semi-rigid plastic material but as pointed out, the fibrous material had many other difficulties including moisture absorbtion, discoloration and limpness. By using heat and pressure to groove and fold over the flap as set forth herein, improved bacon packages using impervious semi-rigid plastic trays and flaps are possible and the problems of the fibrous board trays are eliminated.

Although the present invention has been described with reference to a single illustrative embodiment thereof, it should be understood that numerous other modifications and embodiments can be devised by those skilled in the art that will fall within the spirit and scope of the principles of this invention.

I claim:

1. A method of packaging sliced bacon strips arranged in shingled relation in a bacon shingle comprising the steps of first placing a shingle of sliced bacon on top of a body portion of a flat sheet of semi-rigid impervious styrene plastic material having an integral flap formed along a fold line between said body portion and said flap with an edge of said shingle closely adjacent said fold line, heating said plastic material only in a narrow trough formed along said fold line to an elevated bending temperature, folding said flap along said fold line over and downwardly toward an edge portion of said shingle of sliced bacon on said body portion and applying pressure to said fold line to effect a permanent set to said folded flap to permanently overlie said edge portion of said shingle of bacon.

2. The method of claim 1 wherein said applying step comprises heating said flap along said fold line and deflecting said flap downwardly toward said edge portion of said bacon on said tray.

3. The method of claim 1 including the step of forming a trough along said fold line during said heating step.

4. Apparatus for making packages for shingles of sliced bacon strips from unitary sheets of flat semi-rigid impervious styrene plastic material having an integral flap along an edge of a body portion defining a fold line, said apparatus comprising means for supporting said sheets with shingles of bacon thereon for movement in sequence along a work path to form said packages, means for moving said sheets loaded with said sliced bacon thereon along a path, means for guiding said loaded sheets aligned with the fold lines thereof along said path, means for heating said sheets only in a narrow groove along said fold lines during movement along said path, means for folding said flaps along said fold lines over and downwardly toward an edge portion of the bacon shingle on said body portion while heated to bending temperature and means for forming a permanent set to said folded flaps overlying said edge portion of said bacon shingle on said body portions.

5. The apparatus of claim 4 wherein said heating means includes a pair of cooperating upper and lower rolls for forming a depressed trough in said sheets along said fold line between said flap and said body portion.

6. The apparatus of claim 5 wherein said lower roll has a groove around the periphery and said upper roll is positioned to deflect said sheets into said groove to form said trough along said fold line.

7. The apparatus of claim 5 wherein said upper roll is mounted for rotation on an axis intersecting the axis of rotation of said lower roll at an acute angle.

8. The apparatus of claim 5 wherein at least one of said rolls are heated for deforming said sheets to provide a permanent fold.

9. The apparatus of claim 4 wherein said means for setting said folded flap includes a pair of upper and lower cooperating rolls, said upper roll having a frustroconical surface engaging said folded flaps to set the same in a position deflected downwardly toward said shingles of sliced bacon on said body portion of said sheets.

10. The apparatus of claim 9 wherein said upper roll is formed of resilient material.

11. The apparatus of claim 9 wherein said upper roll includes segments having different hardness engaging said folded flaps.

12. The apparatus of claim 11 wherein a roll segment engaging said flap along said fold line is of harder material than a segment engaging said flap away from said fold line.

* * * * *